US005553401A

United States Patent [19]

Wittmann et al.

[11] Patent Number: 5,553,401

[45] Date of Patent: Sep. 10, 1996

[54] PRESSURE-DISTRIBUTING PLATES FOR THE INSTEP REGION OF A SKI BOOT

[75] Inventors: Heinz Wittmann, Vienna, Austria; Francesco Caeran, Montebelluna, Italy; Martin Elsner, Graz, Austria

[73] Assignee: HTM Sport- und Freizeitgeraete Aktiengesellschaft, Schwechat, Austria

[21] Appl. No.: 327,102

[22] Filed: Oct. 21, 1994

[30] Foreign Application Priority Data

Oct. 21, 1993 [AT] Austria ..... 2127/93

[51] Int. Cl.[6] ..... A43B 5/04; A43B 5/16

[52] U.S. Cl. ..... 36/117.6; 36/117.1

[58] Field of Search ..... 36/117, 118, 119, 36/120, 121

[56] References Cited

U.S. PATENT DOCUMENTS

| | | | |
|---|---|---|---|
| 4,914,839 | 4/1990 | Paris et al. | 36/119 |
| 4,920,666 | 5/1990 | Marega | 36/119 |
| 4,937,953 | 7/1990 | Walkhoff | 36/117 X |
| 5,001,851 | 3/1991 | Baggio et al. | 36/117 X |
| 5,363,571 | 11/1994 | Montfort | 36/120 X |
| 5,381,611 | 1/1995 | Tonel et al. | 36/117 |
| 5,410,882 | 5/1995 | Vaccari | 36/117 |

*Primary Examiner*—Paul T. Sewell
*Assistant Examiner*—BethAnne C. Dayoan
*Attorney, Agent, or Firm*—Flynn, Thiel, Boutell & Tanis, P.C.

[57] ABSTRACT

A sports shoe, in particular a ski boot, which is designed with a front instep, and the sole and the upper part of which are formed of plastic, and which has two pressure-distributing plates in the instep area, with each of these pressure-distributing plates extending from the toe area of the shoe over the instep area and, bent upwardly, along the front side of the shaft of the shoe. The pressure-distributing plates are supported for movement in a transverse direction of the shoe and for movement in a longitudinal direction of the shoe and with respect to the upper part in the fore-foot area of the upper part by means of flaps extending in transverse direction of the shoe. The two pressure-distributing plates overlap one another in the closed state of the shoe. The flaps are integrated in one piece with the pressure-distributing plates and are connected through a hinge to the pressure-distributing plates, this hinge enabling a movement of the pressure-distributing plates in the transverse direction of the shoe. The flaps are supported for movement in the longitudinal direction of the shoe on the upper part of the shoe.

11 Claims, 3 Drawing Sheets

PRESSURE-DISTRIBUTING PLATES FOR THE INSTEP REGION OF A SKI BOOT

FIELD OF THE INVENTION

The invention relates to a sports shoe, in particular a ski boot, which is designed with a front instep, and the sole and the upper part of which are formed of a plastic, and which has two pressure-distributing plates in the instep area, with each of these pressure-distributing plates extending from the toe area of the shoe over the instep area and, bent upwardly, along the front side of the shaft of the shoe, and being supported for movement in a transverse direction of the shoe and for movement in a longitudinal direction of the shoe with respect to the upper part in the fore-foot area of the upper part by means of flaps extending in the transverse direction of the shoe, and the two pressure-distributing plates overlapping one another in the closed state of the shoe and covering the instep.

BACKGROUND OF THE INVENTION

The pressure-distributing plates provided in shoes of the abovementioned type are supposed to absorb and distribute the forces which result during a tight clamping together of the shoe parts, as it is carried out to achieve a tight fit of the shoes on the user's foot in order to essentially avoid a point-by-point action of the pressure-applying forces on the foot; these pressure-distributing plates are furthermore also supposed to achieve through their movability in longitudinal direction of the shoe an adaptation of the shape of the shoe to the shape of the foot. In order to step into the shoes and to exit out of the shoes, these pressure-distributing plates, which are connected to the upper part of the shoe on the right and on the left of the instep opening of the shoes, must be moved away from one another in the transverse direction of the shoe in order to free the instep opening and to thus enable the stepping into or out of the shoe.

Shoes of the aforementioned type are known in which the pressure-distributing plates are connected to the upper part of the shoe by means of flaps in the form of flexible steel bands, on which the pressure-distributing plates are movably arranged in longitudinal direction of the shoe, with tensioning-lever buckles being also mounted on the flexible steel bands, which buckles are provided to clamp the shoe parts together to close the instep opening. In order to open or free the instep opening of the shoes, the pressure-distributing plates must be moved outwardly in the transverse direction of the shoe, with the flexible steel bands on which the pressure-distributing plates are fastened, being bent elastically outwardly. The flaps, which are designed like elastic steel bands, apply thereby a force which intends to move the pressure-distributing plates into their position covering the instep opening so that the pressure-distributing plates, as long as the instep opening is supposed to be kept open and free of obstruction, must be manually held apart against the force applied by the elastic steel bands. This can cause great difficulties during a stepping into the shoes and possibly also during a stepping out of the shoes. When the tensioning-lever buckles are mounted on the elastic steel bands forming the fastening flaps of the pressure-distributing plates in these conventional shoes, an exchanging of a part of the tensioning-lever buckle is made difficult because the pressure-distributing plates supported on the steel band carrying the buckle part must be completely removed from the upper part of the shoe. Only thereafter can the necessary buckle repair be carried out, and subsequently the respective pressure-distributing plate must again be remounted. Also these requirements becoming necessary in the case of a repair on a tensioning-lever buckle provided for closing the shoe can be considered as a disadvantage for the mounting of the pressure-distributing plates and of the tensioning-lever buckles existing in the mentioned conventional sports shoe.

It is a goal of the invention to provide a sports shoe of the abovementioned type, in which problems of the abovementioned type are overcome, and in which in a structurally simple and easily manufacturable manner the transverse movability of the pressure-distributing plates for opening or freeing of the instep opening of the shoe and the longitudinal movability of the pressure-distributing plates for adapting the shoe to the foot can be realized, and in which, without influencing one another, the tensioning-lever buckles or parts thereof on the one hand and the pressure-distributing plates on the other hand can, if necessary, be repaired or fixed.

The inventive sports shoe of the abovementioned type is characterized by the flaps being integrated in one piece with the pressure-distributing plates through a hinge, this hinge enabling a movement of the pressure-distributing plates in a transverse direction of the shoe, and by the flaps being supported for movement in the longitudinal direction of the shoe on the upper part of the shoe The above disclosed goal can be met well with this design. It is possible during a forming of the pressure-distributing plates from a plastic material to, at the same time, also form the flaps in a simple manner and with very little additional work and to mount these flaps in a very simple manner longitudinally movably on the upper part of the shoe. The movability of the flaps in longitudinal direction of the shoe causes thereby also a corresponding movability of the pressure-distributing plates. By connecting the pressure-distributing plates to the flaps provided thereon through a hinge, the pressure-distributing plates can easily and without any special force be swung to the side for opening or freeing the instep of the shoe from obstruction. By mounting the flaps on the upper part of the shoe, a good and strong guiding with respect to the movability of the pressure-distributing plates in the longitudinal direction of the respective shoe can be achieved. Further, the tensioning-lever buckles provided for pulling the shoes together can be fastened on the upper part of the shoe independent from the fastening of the pressure-distributing plates.

A structurally very simple design of the hinge between the individual flaps and the respective pressure-distributing plate, to which these flaps are connected, in connection with a very long lifetime of the hinge and in connection with a very easy movability of the pressure-distributing plate with respect to the flaps can be achieved through a preferred embodiment of the sports shoe, which is characterized by the hinge, through which the individual flaps are connected to the respective pressure-distributing plate, being formed by a thin film living hinge.

For the desired easy longitudinal movability of the pressure-distributing plates, it can be advantageous that the upper part of the shoe are provided with upstanding bolts and the slotted holes forming a guideway are provided in the flaps. Furthermore, an advantageous embodiment results thereby with respect to the manufacture of the bolts provided for the cooperation with the slotted holes of the guideways and with respect to a simple assembly of the bolts with the slotted holes of the guideways when it is provided that the bolts provided for the cooperation with the slotted holes of the guideways are formed on the upper part of the shoe.

A preferred embodiment of the sports shoe of the invention, which embodiment achieves a good protection of the guideways enabling the longitudinal movement of the pressure-distributing plates against negative outside influences, as, for example, snow, ice and dirt, is characterized by the flaps, when the pressure-distributing plates are in a position above the instep, being hinged to a location beneath the pressure-distributing plate to which they are connected, and extend in direction of the instep opening of the shoe. This embodiment offers also the further advantage that by hinging the flaps in under the pressure-distributing plates, usually a small force acting in direction of a sideward opening movement of the pressure-distributing plates results, which keeps the instep opening of the shoe open and free of obstruction in the rest condition so that an additional manual holding open of the instep opening during a stepping into and out of the shoe is not needed. An advantageous further development of this embodiment, in which the hinge through which the individual flaps are connected to the pressure-distributing plates, are essentially relieved of forces which act in longitudinal direction of the shoe, and which occur during movement of the pressure-distributing plates in the longitudinal direction of the shoe, is characterized by providing supports on the inside facing surface of the pressure-distributing plates facing the inside of the shoe, which supports are arranged next to the edges of the turned-in flaps, which edges extend in transverse direction of the shoe, and support these flaps on the respective pressure-distributing plate against a movement in the longitudinal direction of the shoe, which movement occurs relative to the associated pressure-distributing plate. With respect to the finishing technique, it is thereby advantageous to provide that the supports are integrally formed on the inside of the pressure-distributing plates. It can be furthermore advantageous to provide, in the interest of keeping the movement forces acting onto the flap small and in the interest of achieving an easy longitudinal movability of the pressure-distributing plates that the height of the supports provided on the inside facing surface of the pressure-distributing plates is higher than the height of the flaps and guide parts for the flaps, which guide parts project beyond the flap height and are connected to the upper part of the shoe.

A structural alternative to the above-discussed embodiment, which alternative is very simple with respect to the installation of the pressure-distributing plates, and in which alternative the flaps rest below the pressure-distributing plates, is characterized by the flaps extending in the transverse direction of the shoe away from the outer edge of the respective pressure-distributing plate.

It is furthermore advantageous, in the interest of achieving an easy longitudinal movability of the pressure-distributing plates, when it is provided that the pressure-distributing plates have a support rib at their edge, which support rib, when the shoe is closed, rests on the upper part of the shoe. Such a support rib can also perform a sealing function, for example, preventing the penetration of snow and ice or dirt into the interior of the shoe.

It is furthermore advantageous for achieving an easy movability of the two pressure-distributing plates, which lie one above the other in the closed state of the shoe, when it is provided that the inner one of the two pressure-distributing plates of the shoe carries a support rib on its upper side, on which rests the pressure-distributing plate lying to the outside thereof.

BRIEF DESCRIPTION OF THE DRAWINGS

The invention will now be discussed further in connection with examples, with reference to the drawings, in which:

FIG. 5 is a cross-sectional view of the pressure-distributing plate illustrated in FIG. 3 taken along the line V—V of FIG. 3 with the flaps not yet turned in.

DETAILED DESCRIPTION

Figure 1:
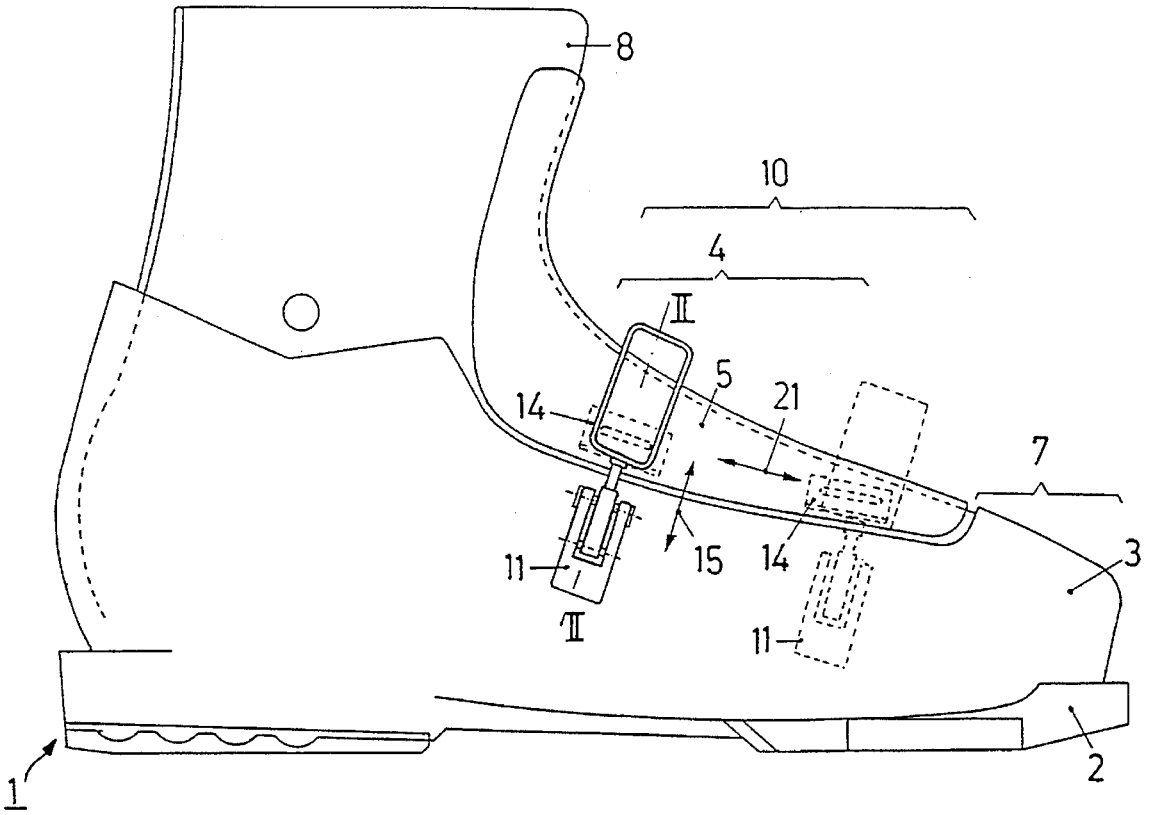
FIG. 1 is a side view of an embodiment of a shoe designed according to the invention.
Figure 2:
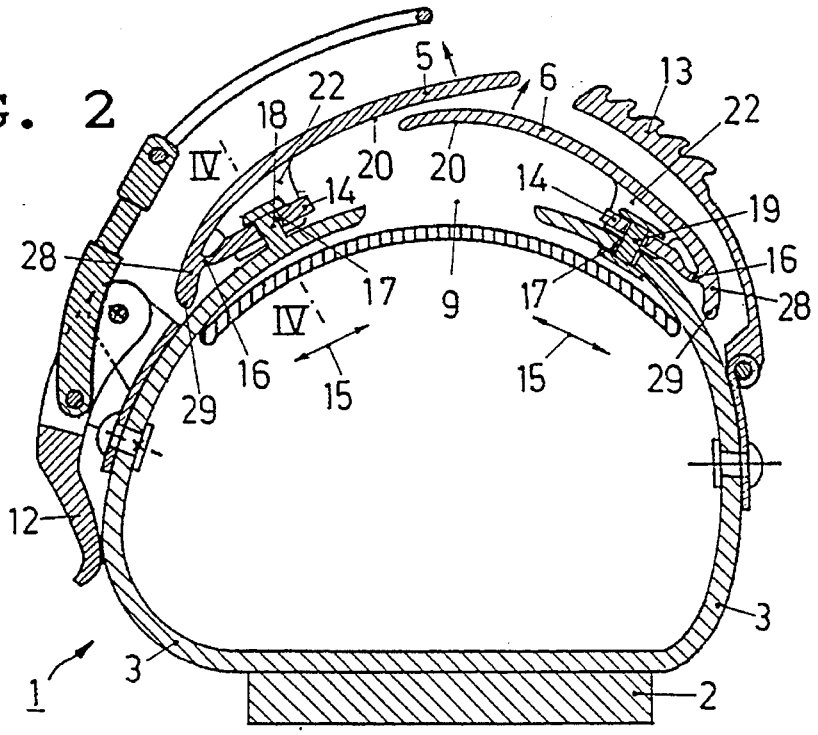
FIG. 2 is a cross-sectional view of this shoe taken along the line II—II of FIG. 1.

The embodiment of a sports shoe 1, namely a ski boot, which embodiment is illustrated in FIGS. 1 and 2, has a sole 2 and an upper part 3 which are formed of a plastic. This shoe has two pressure-distributing plates 5, 6 in the instep area 4, which plates extend from the toe area 7 over the instep area and, bent upwardly, along the front side of the shaft 8 of the shoe. The upper part 3 of the shoe 1 has, in order to form a front instep, a longitudinally extending opening 9 on its upper side. In order to close the shoe, opposite sides of the opening 9 in the upper part are thereby pulled together to narrow down the opening 9 by two tensioning-lever buckles 11 provided in the fore-foot area 10 of the shoe, which buckles are formed of a tensioning-lever part 12 and a hook part 13. FIG. 1 shows in detail only one of these tensioning-lever buckles 11, the other one is only indicated by dashed lines. The tensioning-lever parts 12 of the tensioning-lever buckles are fastened on the one side of the upper part 3, the hook parts 13 of the tensioning-lever buckles are fastened on the other side of the upper part 3.

The pressure-distributing plates 5, 6, which are provided for distributing the pressure effects which are applied by the tensioning-lever buckles during a closing thereof and in the closed state onto the foot over a larger surface, and which furthermore make stepping into and stepping out of the opening 9 in instances of a relatively stiffly designed upper part 3 easier, are fastened on the upper part 3 by means of flaps 14 which extend in transverse direction of the shoe, which direction is indicated by the arrows 15. The flaps 14 are integrated with the pressure-distributing plates 5, 6 and are each connected to the pressure-distributing plates through a hinge point 16 which, in the present case, is designed as a thin film living hinge. This hinge permits, when the flaps 14 are mounted on the upper part 3 of the shoe, a hinging movement of the pressure-distributing plates in transverse direction of the shoe. The flaps 14 are, independent of the mounting of the tensioning-lever buckles 11, mounted movably in a longitudinal direction of the shoe indicated by the double arrow 21 on the upper part 3 of the shoe. This movability of the flaps 14 is made possible by slotted-hole bolt guideways, with slotted holes 17 being in the illustrated case provided in the flaps 14, and bolts 18, 19 being provided on the upper part 3 and cooperating with the slotted holes 17, namely, being received in the slotted holes of the shoe. The bolt 18 illustrated on the left side in FIG. 2 is designed as integrally formed shoulder on the upper part 3, whereas the bolt 19 illustrated on the right side in FIG. 2 is designed as a rivet inserted into a bore of the upper part 3. Due to the movability of the flaps 14 in a longitudinal direction of the shoe, it is also possible for the pressure-distributing plates, which are designed integrally with the flaps, to be moved in a longitudinal direction of the shoe. While the slotted hole bolt guideways are, in the case illustrated in FIG. 1 and 2 and discussed above, provided in the flaps, it is, however, also possible to provide suitable slotted holes in the upper part 3 of the shoe and to mount the bolts, which are part of the slotted-hole bolt guideways, on the flaps 14.

The flaps 14 are turned in under the pressure-distributing plate to which they are connected, and extend thereby toward the opening 9 in the position of the pressure-distributing plates 5, 6, which position is illustrated in FIG. 2 and lies above the instep of the shoe, which instep is formed by the opening 9. Thus, the flaps and the guideways thereof are well protected against disadvantageous outside influences as, for example, impacts, dirt, snow and ice, and such influences do not have any negative effect on the longitudinal movability of the pressure-distributing plates.

Figure 4:
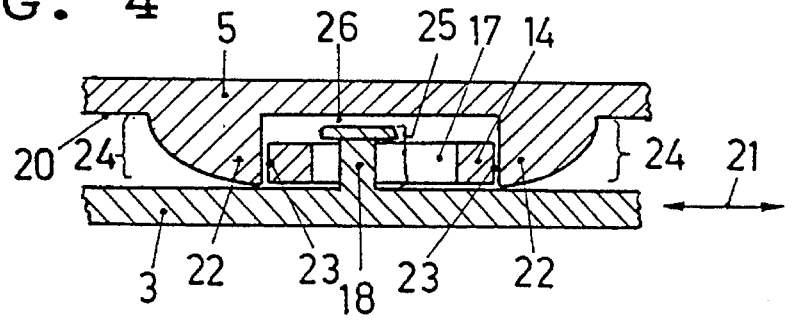
FIG. 4 is a cross-sectional view of the shoe illustrated in FIGS. 1 and 2 taken along the line IV—IV of FIG. 2.

Practice has shown that the easily flexible living hinges, which are very simple in their design, can withstand significant stress and can attain a long life. Such living hinges can easily withstand forces which are applied transversely directed with respect to the axis of the living hinge, and also forces which are applied approximately in direction of the axis. Nevertheless, it can be considered to be advantageous to protect the living hinges against outside forces which act from outside onto the pressure-distributing plates. Supports 22 are provided for this purpose, as illustrated in FIG. 4, on the inside facing surface 20 of the pressure-distributing plates 5, 6 and face the inside of the shoe. The supports 22 are arranged adjacent the edges 23 of the turned-in flaps 14, which edges extend in transverse direction of the shoe; forces, which cause a movement of the pressure-distributing plates in longitudinal direction of the shoe, can be transferred onto the edges 23 of the flaps 14 through the supports 22, and the flaps 14 are in this manner supported against a movement in a longitudinal direction 21 of the shoe relative to the associated pressure-distributing plates, and the living hinges are thus essentially relieved of such forces of movement. The supports 22 can be easily formed during the manufacture of the pressure-distributing plates on the inside thereof. However, it is also possible to mount such supports subsequently, for example by welding. It is advantageous to have the height 24 of the supports 22 provided on the inside 20 of the pressure-distributing plates 5, 6 be higher than the height 25 of the flaps and of guide parts projecting beyond the flap height, which guide parts are connected to the upper part 3 of the shoe as, for example, the bolts 18; thus a spacing 26 is formed above the flaps 14 and possibly above the projecting guide parts so that the flaps 14, bolts 18 or the like are not constrained, which could hinder the path of movement of the pressure-distributing plate in the longitudinal direction 21 of the shoe.

Figure 3:
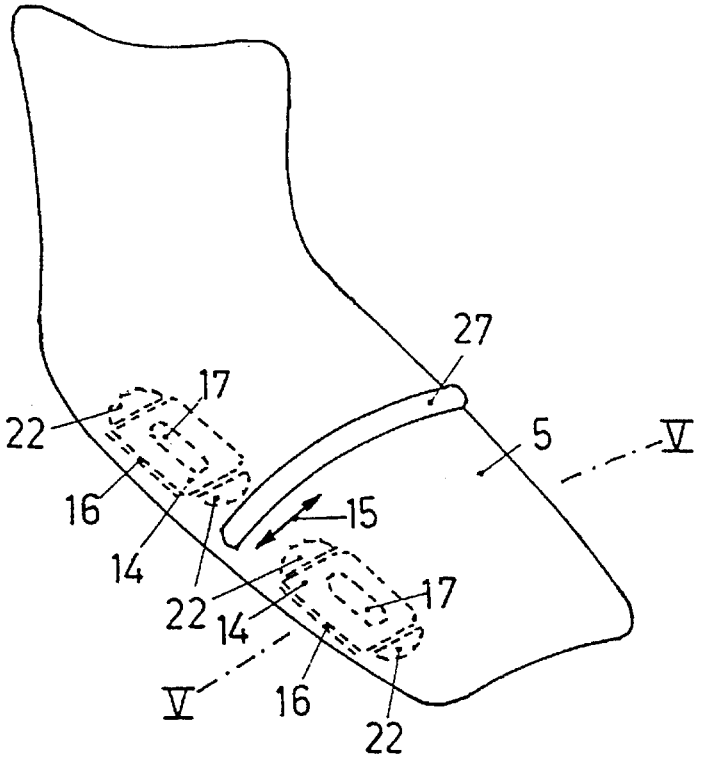
FIG. 3 is a view of an embodiment of a pressure-distributing plate provided for such a shoe in the built-in state.

FIG. 3 shows a further facilitative measure, namely, a support rib 27 being provided on the inside facing surface of the upper one of the pressure-distributing plate 5, on which support rib, when the shoe is closed, rests the outwardly facing surface of the pressure-distributing plate 6. Such a support rib 27 makes a movement of the two pressure-distributing plates 5, 6 toward one another and thus an adapting of the position of the pressure-distributing plates to the shape of the foot of the wearer of the shoe easier. In the alternative, the rib could be provided on the pressure-distributing plate 6 and adapted to engage the inside facing surface of the pressure-distributing plate 5.

The pressure-distributing plates 5, 6 are advantageously facilitatively provided with a support rib 29 adjacent an outside edge 28 thereof. The support rib rests, when the shoe is closed, on the upper part of the shoe, makes a sliding movement of the pressure-distributing plates relative to the upper part of the shoe easier, and has a sealing action preventing foreign material from entering the space existing under the pressure-distributing plates.

Figure 5:
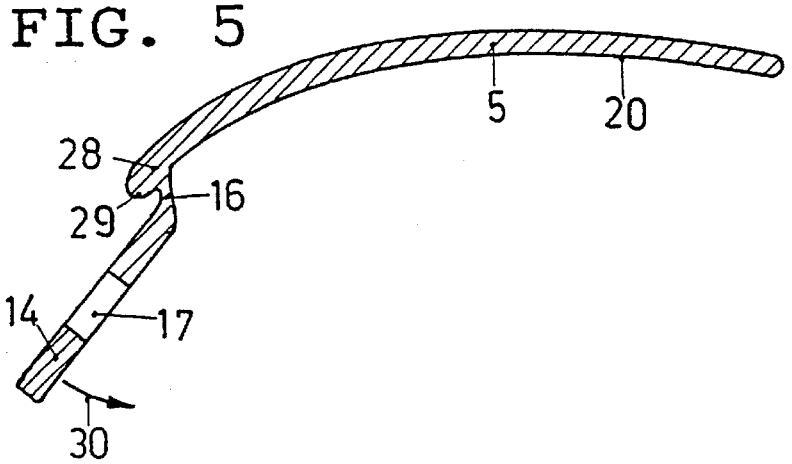

FIG. 5 shows a pressure-distributing plate 5, as it is illustrated in FIG. 3, in the state created during its manufacture, namely, prior to the flaps 14 integrated with this pressure-distributing plate 5 having been turned in in the direction of the arrow 30 toward the inside facing surface 20 of the pressure-distributing plate. The flap 14 pivots during this turning-in movement about the hinge location 16 designed as a living hinge. A support rib 29 is arranged at the edge 28 of the pressure-distributing plate 5. The flap 14 has a slotted hole 17 extending therethrough which, as has been discussed above, in cooperation with a bolt inserted into such a slotted hole, forms a guideway enabling a longitudinal movement (in a direction perpendicular with respect to the drawing plane).

Figure 6:
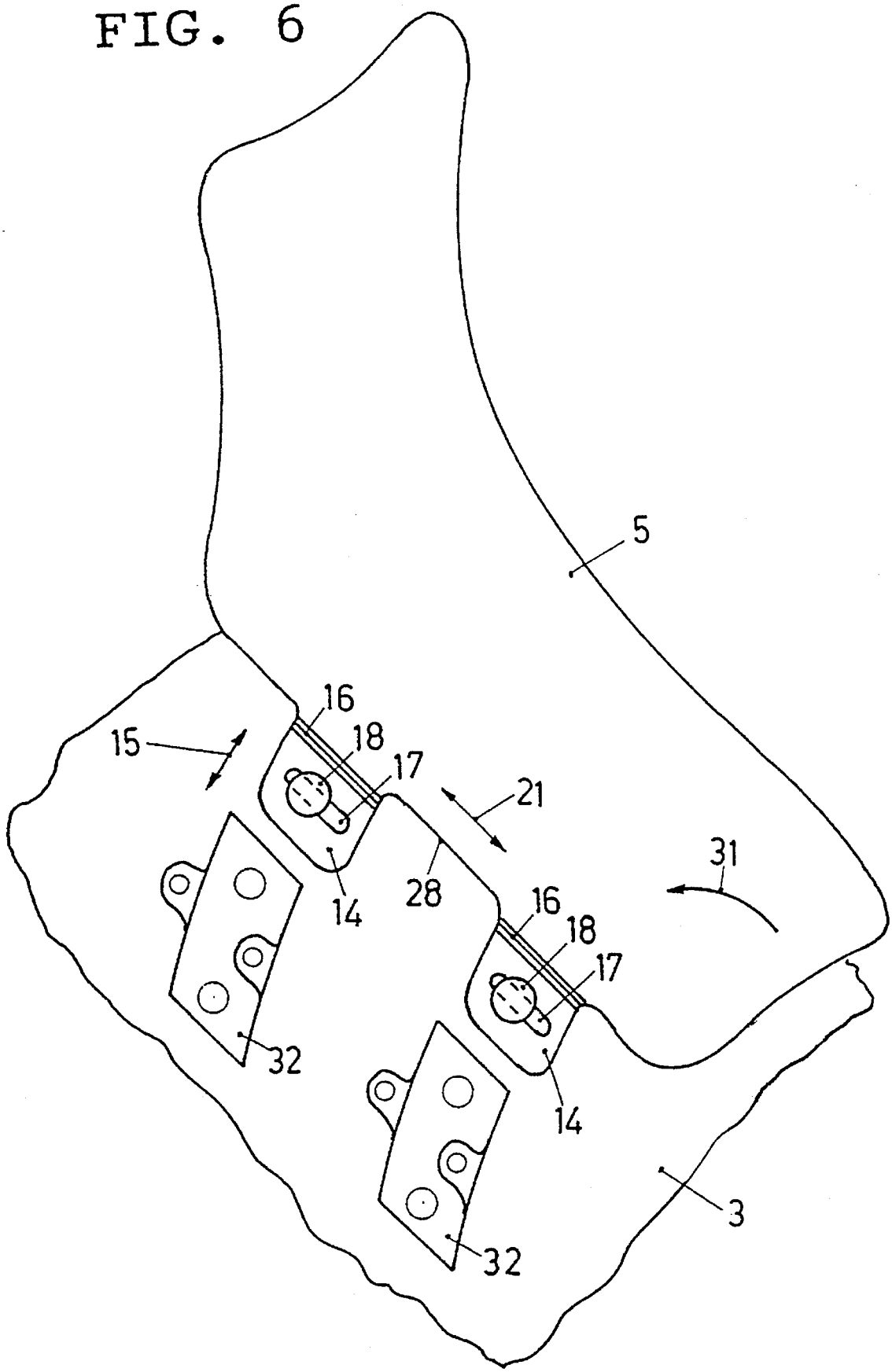
FIG. 6 is a partial view of a different embodiment of a shoe designed according to the invention.

The flaps 14 integrated with the pressure-distributing plate 5, in the part of an embodiment of a shoe designed according to the invention, which part is illustrated in FIG. 6, extend in the transverse direction 15 of the shoe away from the outer edge 28 of the pressure-distributing plate 5. Slotted holes 17 are provided in the flaps 14, which slotted holes together with the bolt 18 form a slotted-hole bolt guideway, with the associated bolts 18 being mounted or formed on the upper part 3 of the shoe. The pressure-distributing plates can thus through these guideways carry out a movement in the longitudinal direction 21 of the shoe, and the pressure-distributing plates can furthermore carry out an opening movement in direction of the arrow 31, with the respective pressure-distributing plate pivoting with respect to the flaps 14 integrated with it about the hinge joint 16 designed as the living hinge. The bearings 32 of the tensioning-lever buckles provided for closing or rather pulling together of the upper part of the shoe are also in this embodiment fastened on the upper part 3 of the shoe independent of the pressure-distributing plates.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski boot having a sole and an upper part secured to said sole, an upper region of said upper part defining a shaft of said ski boot, said upper part having an open front instep region, first and second pressure-distributing plates being provided in said instep region, each of said first and second pressure-distributing plates extending from a toe area of said ski boot over said instep region to close said instep region, said first and second pressure-distributing plates being bent upwardly along the front side of said shaft of said ski boot with support means being provided for supporting said first and second pressure-distributing plates for movement both in a transverse direction and in a longitudinal direction of said ski boot and with respect to said upper part, said support means including flaps on each of said first and second pressure-distributing plates which extend in said transverse direction of said ski boot, said first and second pressure-distributing plates overlapping one another in said closed instep region of said ski boot, the improvement wherein said flaps are integrally formed in one piece with each of said first and second pressure-distributing plates and are connected through means defining a hinge to each of said first and second pressure-distributing plates, said hinge enabling a movement of said first and second pressure-distributing plates in said transverse direction of said ski boot, and wherein said flaps are supported for movement in said longitudinal direction of said ski boot on said upper part of said ski boot.

2. The ski boot according to claim 1, wherein each said hinge, through which said individual flaps are connected to said first and second pressure-distributing plates, is defined by a thin film living hinge.

3. The ski boot according to claim 1, wherein said upper part of said ski boot is provided with upstanding bolts and slotted holes forming guideways are provided in said flaps.

4. The ski boot according to claim 3, wherein said bolts received in said slotted holes are integrally formed on said upper part of said ski boot.

5. The ski boot according to claim 1, wherein said flaps, with said first and second pressure-distributing plates being in a position closing said instep region, are turned in under each of said first and second pressure-distributing plates and extend in a direction toward said open front instep region of said ski boot.

6. The ski boot according to claim 5, wherein supports are provided on an inside facing surface of each of said first and second pressure-distributing plates, said supports opposing oppositely facing edges of each of said flaps, said edges extending in said transverse direction of said ski boot and engage said supports so as to prevent a relative movement between said support and said first and second pressure-distributing plates in said longitudinal direction of said ski boot.

7. The ski boot according to claim 6, wherein said supports are integrally formed on said inside facing surface of each of said first and second pressure-distributing plates.

8. The ski boot according to claim 6, wherein said supports each have a height on said inside facing surface of each of said first and second pressure-distributing plates that is greater than a thickness of said flaps and a height of said upstanding bolts, said upstanding bolts each projecting beyond the flap and are connected to said upper part of said ski boot.

9. The ski boot according to claim 1, wherein said flaps extend in said transverse direction of said ski boot away from an outer edge of each of said first and second pressure-distributing plates.

10. The ski boot according to claim 1, wherein said first and second pressure-distributing plates are each provided with a support rib at an edge thereof which, when said ski boot is closed, rests on said upper part of said ski boot.

11. The ski boot according to claim 1, wherein an inner one of said first and second pressure-distributing plates of said ski boot has a support rib provided on an upper surface thereof, on which support rib rests the other of said first and second pressure-distributing plates which lies outwardly therefrom.

* * * * *